US006979143B2

(12) United States Patent
Goldberg

(10) Patent No.: US 6,979,143 B2
(45) Date of Patent: Dec. 27, 2005

(54) CARABINER WRITING INSTRUMENT

(75) Inventor: Edward Goldberg, Teaneck, NJ (US)

(73) Assignee: Forever Green Holdings, LLC, Woodbridge, NJ (US)

( * ) Notice: Subject to any disclaimer, the term of this patent is extended or adjusted under 35 U.S.C. 154(b) by 0 days.

(21) Appl. No.: 10/459,317

(22) Filed: Jun. 11, 2003

(65) Prior Publication Data

US 2004/0253038 A1 Dec. 16, 2004

(51) Int. Cl.[7] ..... B43K 23/02; B43K 29/00
(52) U.S. Cl. ..... 401/131; 401/195
(58) Field of Search ..... 401/48, 131, 195; D19/44; 24/10 R, 11 R, 11 FE, 11 HC, 11 S, 24/11 F, 11 M, 11 P

(56) References Cited

U.S. PATENT DOCUMENTS

| | | | | |
|---|---|---|---|---|
| 1,397,818 A | * | 11/1921 | Moore | 24/11 M |
| 1,557,267 A | * | 10/1925 | Mostkoff | 24/11 M |
| 2,174,834 A | * | 10/1939 | Purviance | 24/11 P |
| 2,512,031 A | * | 6/1950 | Marcoux | 24/11 M |
| 3,041,693 A | * | 7/1962 | Simon, Jr. et al. | 24/11 P |
| 4,516,869 A | * | 5/1985 | Corpataux | 401/131 |
| RE32,656 E | | 4/1988 | Bellavance | 401/104 |
| 4,765,767 A | | 8/1988 | Marynissen et al. | 401/213 |
| 5,270,909 A | | 12/1993 | Weiss et al. | 362/208 |
| 5,463,798 A | | 11/1995 | Wurzer | 24/599.5 |
| 6,223,372 B1 | | 5/2001 | Barber | 7/118 |
| D449,857 S | | 10/2001 | Rosenbaum | D19/44 |

OTHER PUBLICATIONS

Copy, catalog page "Fiskars hip clip".
New Dimensions Online printout from www.newdimensions1.com of Carabiner Pens, dated Mar. 12, 2003.

* cited by examiner

*Primary Examiner*—David J. Walczak
(74) *Attorney, Agent, or Firm*—Michael R. Gilman; Kaplan Gilman Gibson & Dernier LLP

(57) ABSTRACT

A carabiner-type attachment for writing instruments in which the carabiner-type attachment device is attached to the side of said writing instrument or the cap therefor. The attachment device is preferably in the form of a carabiner in which at least a portion of the carabiner body is integral with a pen or pen cap. In alternative embodiments the attachment device is removable from said writing instrument or the cap of the writing instrument.

31 Claims, 12 Drawing Sheets

CARABINER WRITING INSTRUMENT

This application claims the benefit of and incorporates by reference the entirety of each of the following U.S. Design Patent Applications:

29/179,838 filed Apr. 15, 2003; 29/179,765 filed Apr. 15, 2003; 29/179,764 filed Apr. 15, 2003, 29/179,766 filed Apr. 15, 2003; 29/179,839 filed Apr. 15, 2003; and 29/180,486 filed Apr. 24, 2003, all entitled WRITING IMPLEMENT WITH CARABINER.

FIELD OF THE INVENTION

The invention relates generally to carabiner-type attachment devices adapted to use on writing instruments such as pens and caps therefor.

BACKGROUND OF THE INVENTION

Carabiners have long been in use for providing a means for attaching articles to each other. Such devices have numerous applications, such as for example enabling multiple articles to be secured to a backpack, purse, handbag, key chain or the like. U.S. Pat. No. 5,005,266 discloses a typical carabiner-type attachment device.

Writing instruments are ubiquitous and in most occupations are indispensable. As such it is useful to be able to attach a writing instrument to a garment, clipboard or the like so as not to misplace the instrument. Heretofore writing instruments have been equipped with resilient clips for attachment purposes. These clips are not suitable for all applications, however. For instance, such clips are not well suited for attaching a writing instrument to a strap, belt loop or the like.

U.S. Design Pat. No. 449,857 discloses an ornamental design for a combination pen and carabiner in which the carabiner is attached by a ring to said pen wherein the pen, when in an attached mode depending from said carabiner, can move freely in relation to the carabiner. Such a design is disadvantageous since the depending pen can swing wildly from the carabiner causing possible injury. Likewise, Fiskars has recently marketed a highlighting pen having a carabiner-like attachment co-molded to the top end of a pen or top end of a pen cap. This device has the similar disadvantage of being subject to swinging freely from an attached position. Moreover, in the embodiment wherein the carabiner is co-molded to the pen cap, the likelihood of the pen unintentionally separating and detaching from the pen cap, when the pen cap is attached by the co-molded carabiner to a strap or the like, is increased when unintended force is applied, i.e., when the depending pen swings from its point of attachment centrifugal force is applied in the precise direction employed to remove said cap for purposes of intended use.

Therefore it would be a considerable advantage to be able to attach the writing instrument to other articles such as but not limited to luggage, belt loops, towel racks, wall hooks, utility belts, backpacks and the like in a manner that is safe and is less likely to result in separation of the writing instrument from the cap employed therewith.

SUMMARY OF THE INVENTION

The present invention provides a carabiner-type attachment for writing instruments in which the carabiner-type attachment device is attached to the side of said writing instrument or the cap therefor. The attachment device is preferably in the form of a carabiner in which at least a portion of the carabiner body is integral with a pen or pen cap.

OBJECTS OF THE INVENTION

It is an object of the present invention to provide a carabiner-type attachment for a writing instrument.

It is another object of the present invention to provide a carabiner-type attachment for a cap for a writing instrument.

It is another object of the present invention to provide a carabiner-type attachment for a writing instrument wherein the carabiner-type attachment device is integral with the writing instrument.

It is another object of the present invention to provide a carabiner-type attachment for a writing instrument wherein the carabiner-type attachment device is detachably connected to the writing instrument.

It is another object of the present invention to provide a carabiner-type attachment for a writing instrument wherein the carabiner-type attachment device is integral with a cap for the writing instrument.

It is another object of the present invention to provide a carabiner-type attachment for a writing instrument wherein the carabiner-type attachment device is detachably connected to a cap for the writing instrument.

It is a further object of the present invention to provide a carabiner-type attachment for a writing instrument wherein the carabiner-type attachment permits safe and secure attachment of the writing instrument to luggage, belt loops, towel racks, wall hooks, utility belts, backpacks and the like.

DETAILED DESCRIPTION OF THE PREFERRED EMBODIMENT

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to "one embodiment" or "an embodiment" means that a particular feature, structure or characteristic described in connection with the embodiment is included in at least one embodiment of the invention. The appearances of the phrase "in one embodiment" in various places in the specification are not necessarily all referring to the same embodiment.

Figure 1:
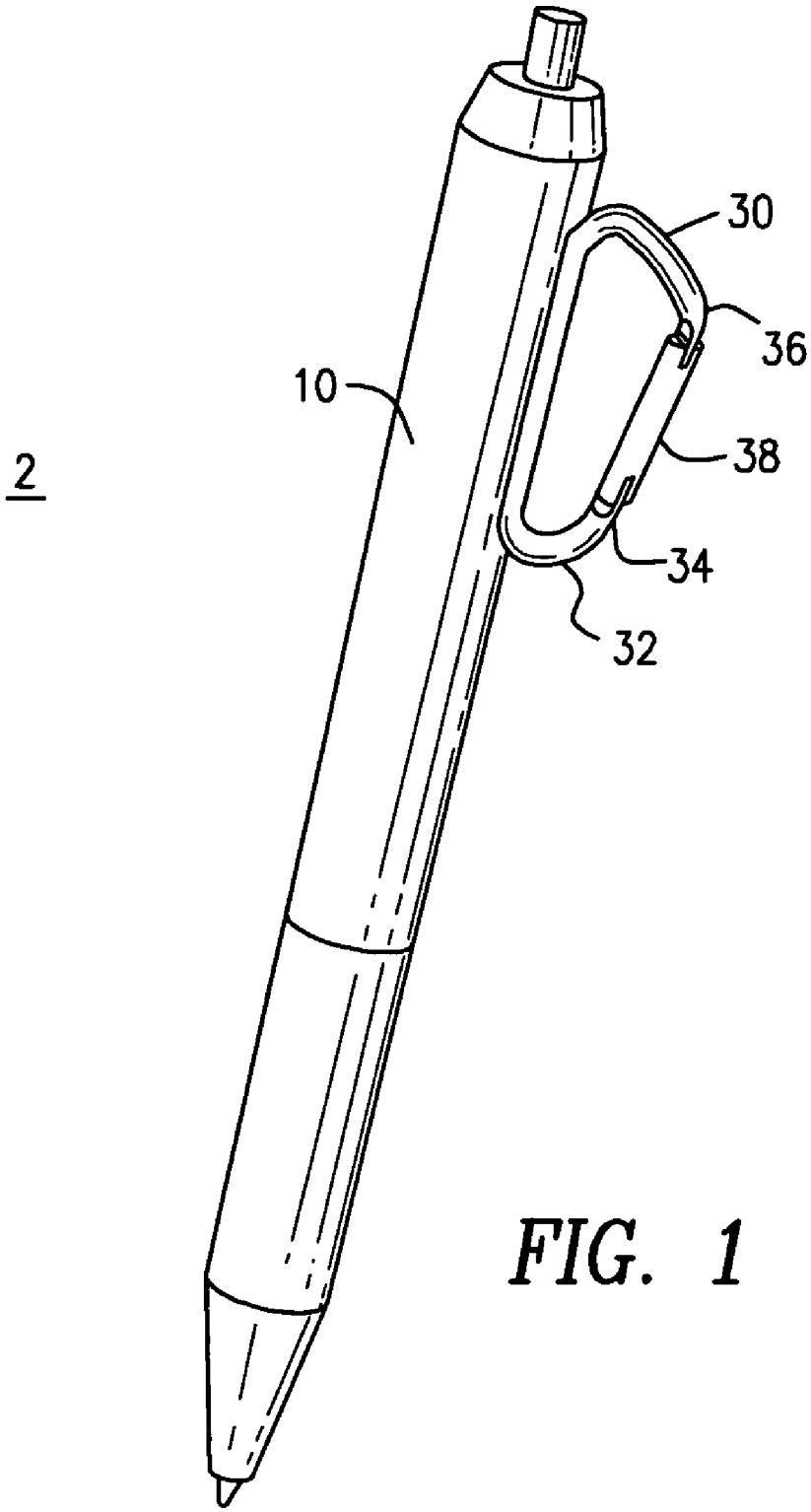
FIG. 1 is perspective view of a preferred embodiment of the present invention.
Figure 1A:
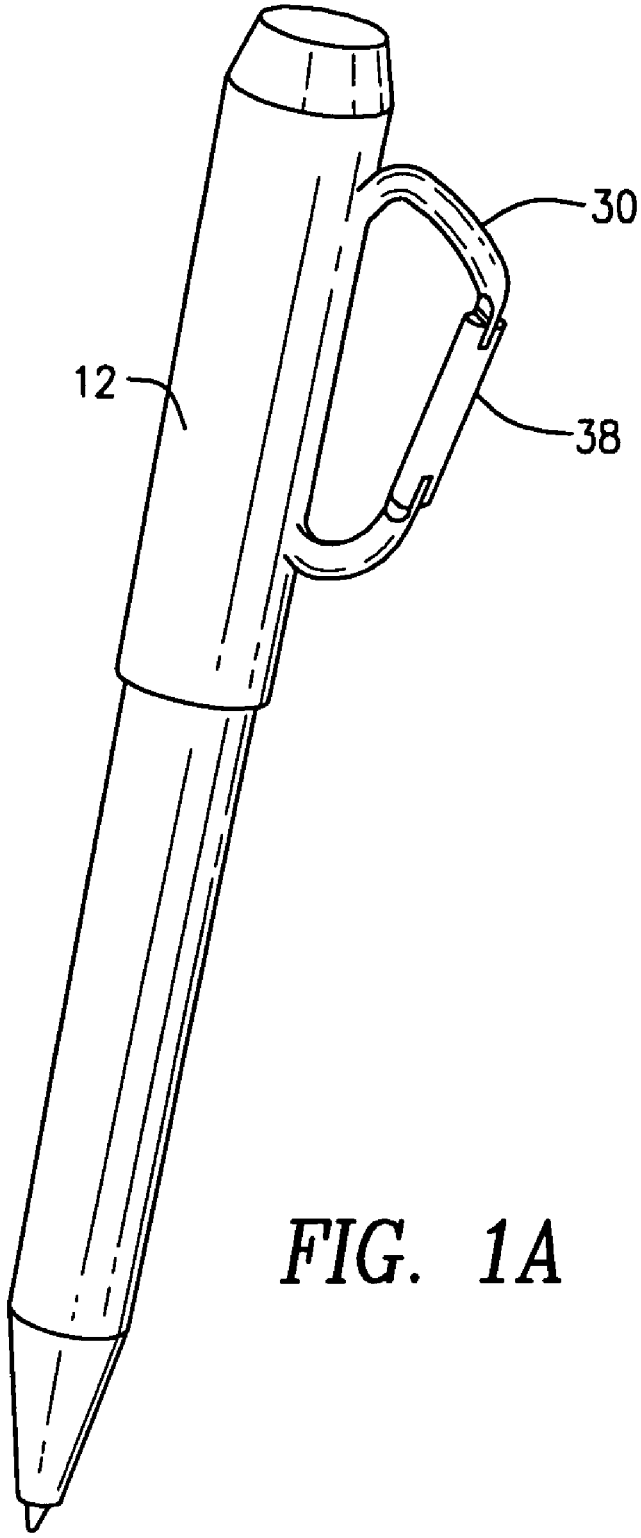
FIG. 1A is a perspective view of a preferred embodiment of the present invention.

Now referring to FIGS. 1 and 1A a preferred embodiment of the device 2 comprises essentially a writing instrument 10 and at least one attachment device 30.

Writing instrument 10 may comprise any suitable writing instrument with or without a cap 12 including but not limited to a pen, pencil, marker or the like as are well known in the art.

Attachment device 30 comprises at least one body member 32 and one openable gate member 38. Now referring to FIG. 1 in a preferred embodiment body member 32 comprises at least a first elongated section comprising a first end 34 and a second end 36 and is typically fabricated of any material suitable for attachment devices such as but not limited to bare or coated metal, wood, rubber, plastic, combinations thereof or any other suitable material as is well known in the art. In a preferred embodiment gate member 38 comprises an elongated member pivotably attached at one end to one end 34 or 36 of said body member 32. The other end of gate member 38 contacts or is in close proximity to the other end 34 or 36 of said body member 32 when said gate 38 is in a closed position. In a preferred embodiment gate member 38 is inwardly openable. Gate member 38 is fabricated of any suitable material as recited above for body member 32, but does not necessarily need to be of the same material as that of body member 32. Gate member 38 may be separately molded and attached to body member 32 by means of a pin or other means well known in the art. In a preferred embodiment body member 32 is curvilinear. In a most preferred embodiment attachment device 30 is formed in the shape of a carabiner but as seen in FIGS. 6–9 other shapes are contemplated by the present invention.

Now referring to FIG. 1A, in a preferred embodiment writing instrument further comprises a cap 12. Attachment device 30 is integrally formed with said cap 12. Now referring to FIG. 1B attachment device 30 is integral with said writing instrument 10. Such integral embodiment may be achieved by any means known in the art appropriate for the material employed in construction of the attachment means, such as for example molding where said attachment means is fabricated of plastic.

Figure 1B:
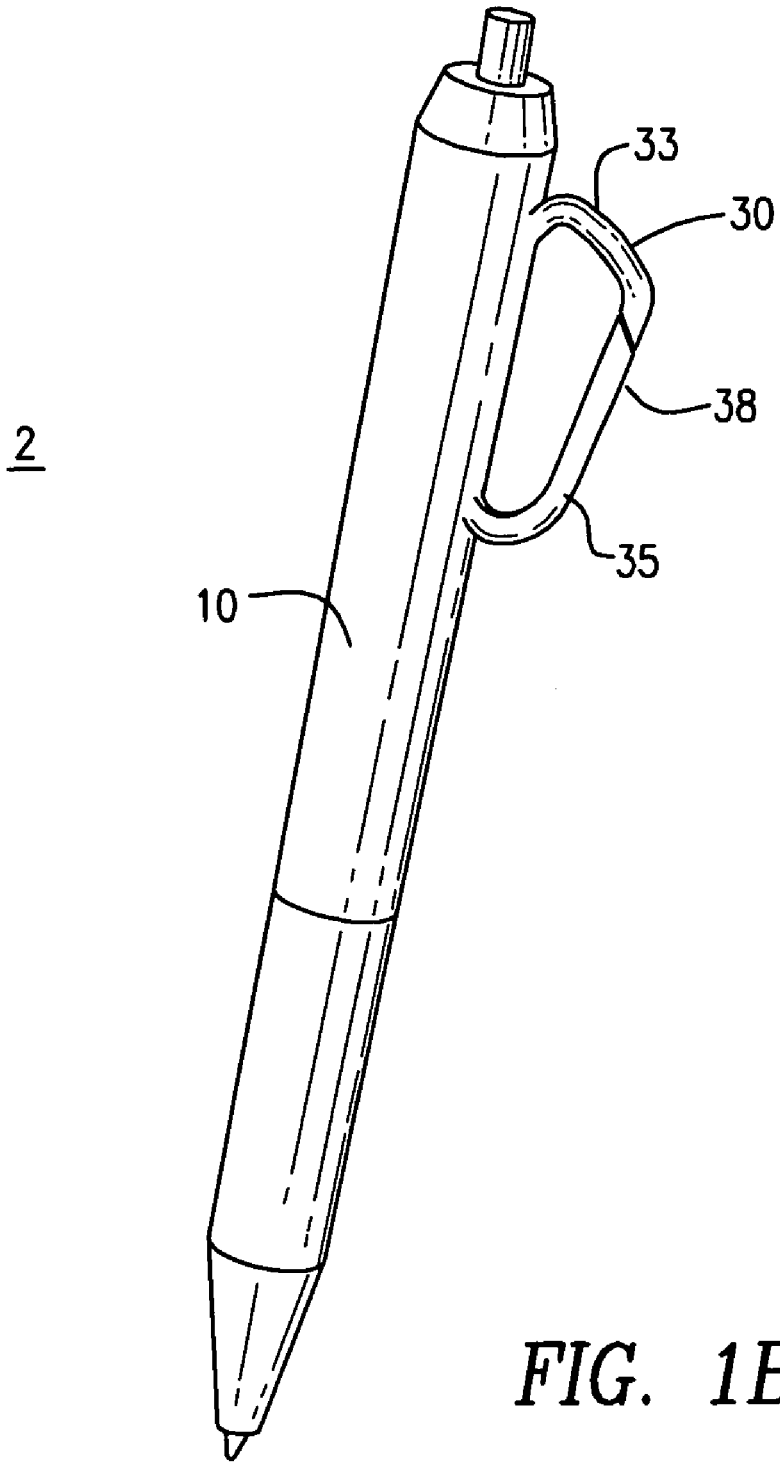
FIG. 1B is a perspective view of a preferred embodiment of the invention.

Now referring to FIG. 1B in one embodiment body member 32 is integral with said writing instrument 10 and comprises at least a first elongated section 33 and second elongated section 35. Gate member 38 comprises an elongated member integrally extending from second elongated member 35. Preferably the integral body 32 and gate member 38 are fabricated of a resilient material such as but not limited to rubber, plastic, or any other suitable resilient material as is well known in the art. A first end of gate member 38 contacts or is in close proximity to an end of said elongated section 33 when said gate 38 is in a closed position. In this embodiment a resilient attachment device is formed without a pivoting hinge. The gate member 38 simply deforms when pressure is applied and resiliently returns to its original position when pressure is released. In a most preferred embodiment attachment device 30 is formed in the shape of a carabiner but other shapes are contemplated by the present invention.

Figure 1C:
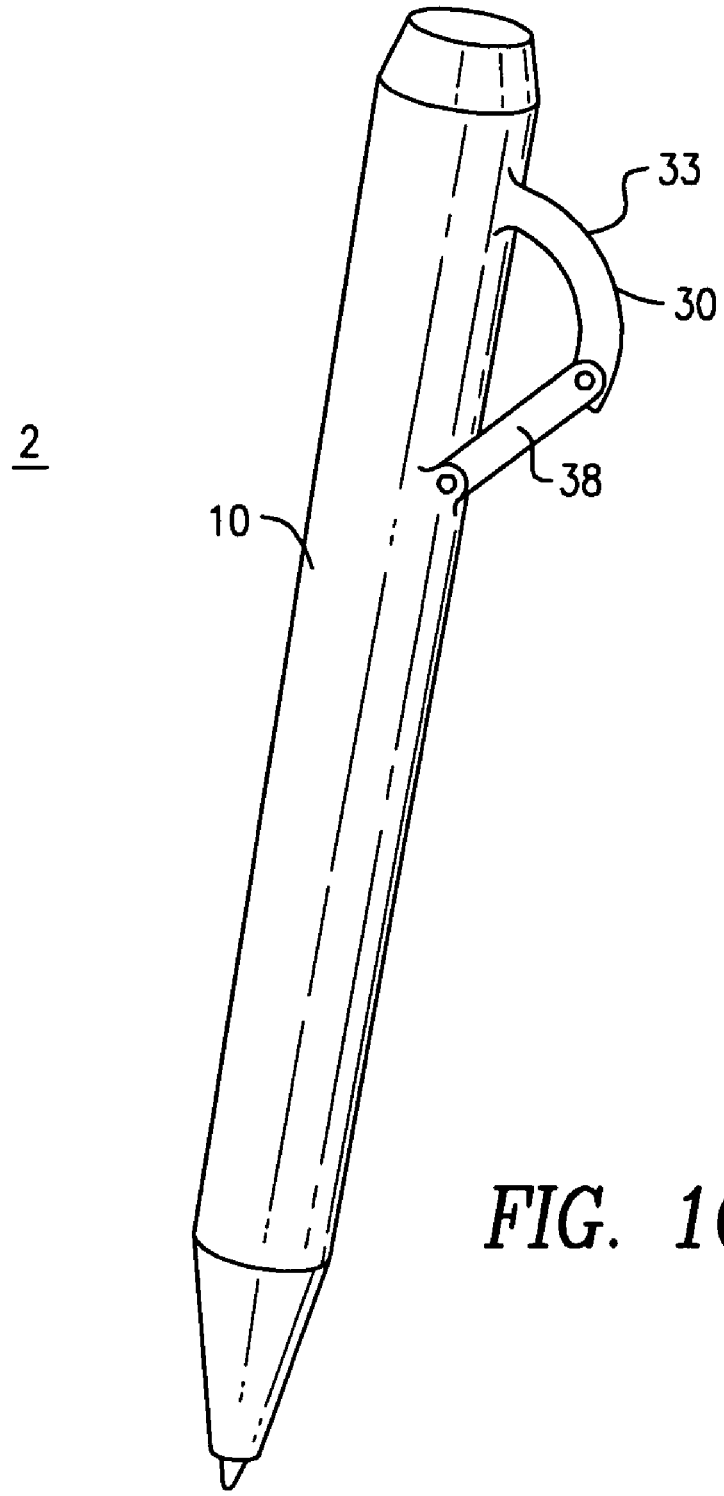
FIG. 1C is a perspective view of a most preferred embodiment of the invention.

Now referring to FIG. 1C in a most preferred embodiment attachment device 30 comprises one elongated section 33 extending from said writing instrument 10 or cap 12 (not shown). Gate member 38 is pivotably attached to said writing instrument 10 or cap 12.

Figure 2:
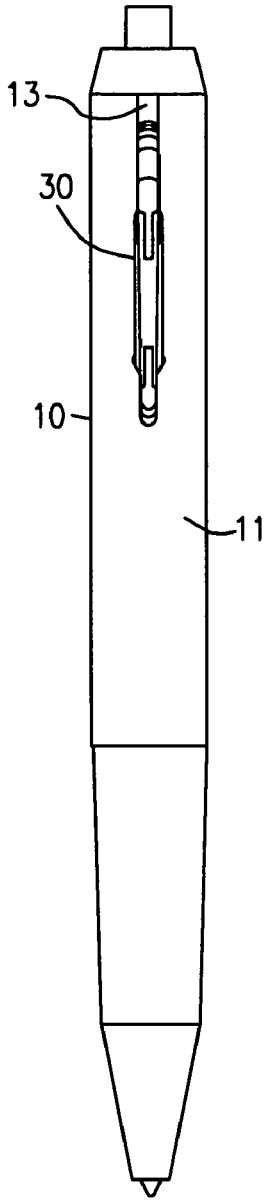
FIG. 2 is a side view of a preferred embodiment of the invention.
Figure 3:
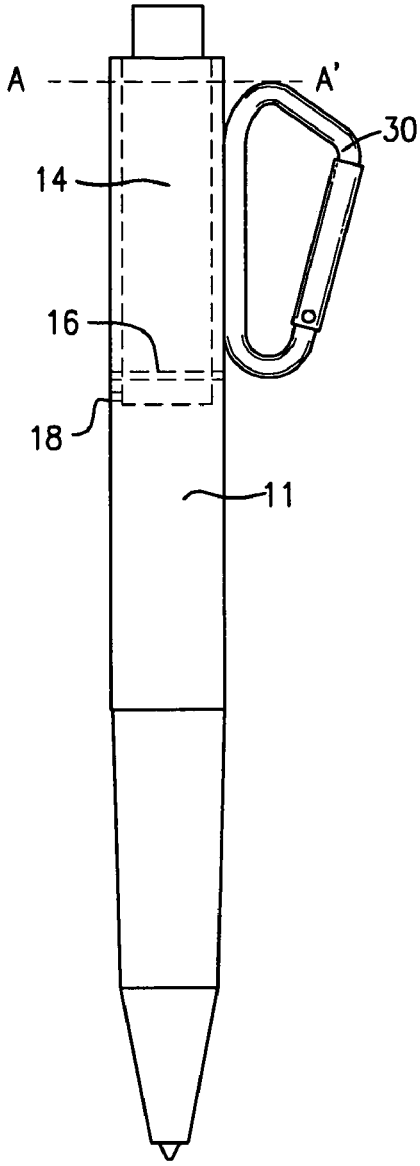
FIG. 3 is a front view of the embodiment of the invention as shown in FIG. 2.
Figure 3A:
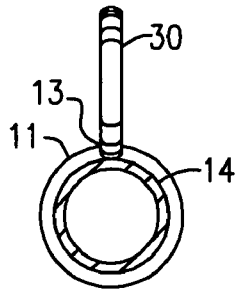
FIG. 3A is a top sectional view of the embodiment of the invention as shown in FIG. 3 through the line A–A'.
Figure 3B:
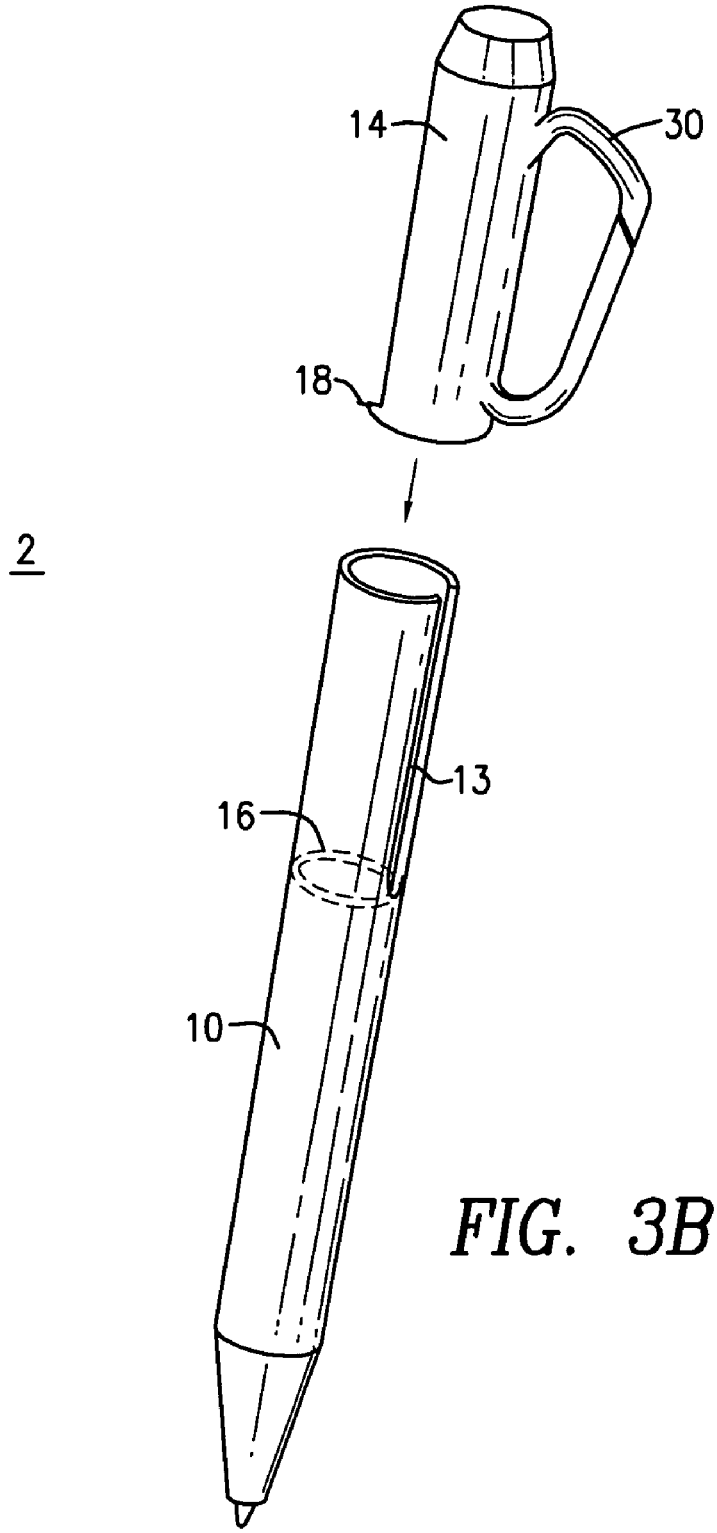
FIG. 3B is an exploded perspective view of the embodiment of the invention as shown in FIGS. 2 and 3.

Now referring to FIGS. 2–3B in an alternate preferred embodiment device 2 comprises a writing instrument 10 comprising an outer sleeve 11 having formed therein a vertical slot 13, and an inner sleeve 14. Now referring to FIG. 3A inner sleeve 14 comprises a peripheral profile that permits it to be engaged within outer sleeve 11. Inner sleeve 14 further comprises attachment device 30 extending therefrom. Inner sleeve 14 is fabricated of any material suitable for use in a writing instrument such as but not limited to bare or coated metal, wood, rubber, plastic, combinations thereof or any other suitable material as is well known in the art. Now referring to FIG. 3A preferably sleeves 11 and 14 are substantially circular in cross-section. Now referring to FIGS. 3A and 3B slot 13 accommodates attachment device 30 when inner sleeve 14 is inserted within outer sleeve 11. Inner sleeve 14 is secured within said outer sleeve 11 by any means known to one having ordinary skill in the art such as but not limited to adhesive or friction engagement. Alternatively a cap may be employed over the end of said writing instrument 10 after insertion of inner sleeve 14. In a most preferred embodiment outer sleeve 11 further comprises an interior lip 16 and inner sleeve 14 further comprises an exterior tab 18 disposed proximal its lower edge to securely engage said inner sleeve 14 within said outer sleeve 11. In this embodiment inner sleeve is preferably formed of a resilient material to enable the engagement of tab 18 under lip 16.

Figure 4:
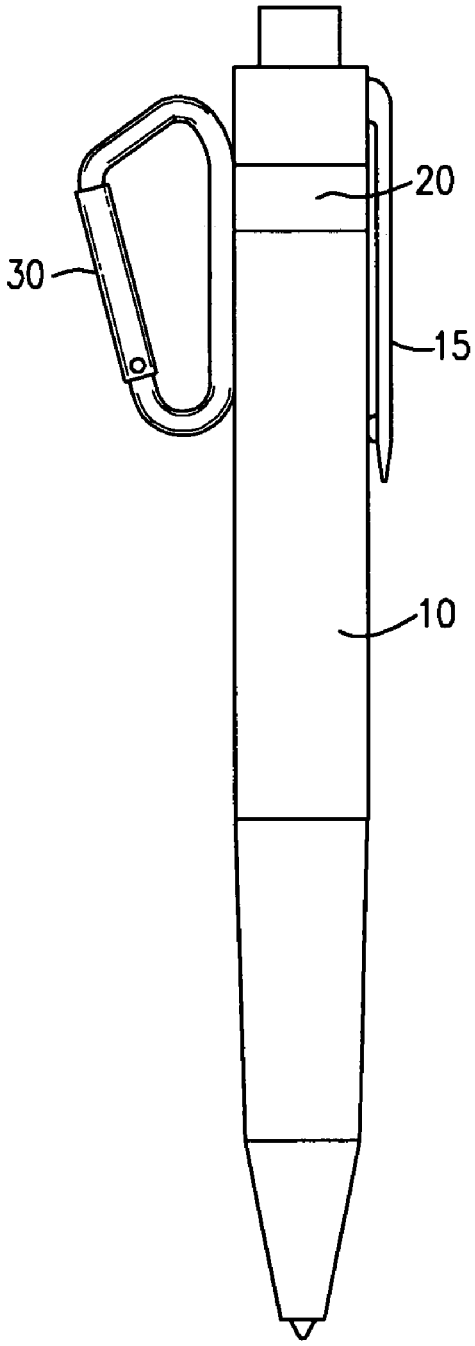
FIG. 4 is a front view of a preferred embodiment of the invention.
Figure 4A:
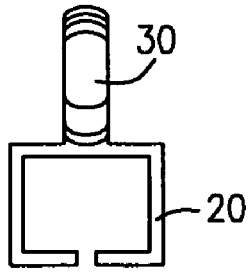
FIG. 4A is a top view of a preferred embodiment of the band element of FIG. 4.

Now referring to FIGS. 4 and 4A, in an alternate embodiment the means for attaching said attachment device 30 to said writing instrument 10 or cap 12 is a band 20 from which attachment device 30 extends. Band 20 comprises any material suitable for use in conjunction with a writing instrument 10 such as but not limited to bare or coated metal, wood, rubber, plastic, combinations thereof or any other suitable material as is well known in the art. In a preferred embodiment band 20 is co-molded with said attachment device 30. In a most preferred embodiment band 20 comprises a cross-section that is substantially similar in shape to the periphery of said writing instrument 10. Now referring to FIG. 4 writing instrument 10 or cap 12 may further comprise a clip 15.

Figure 5:
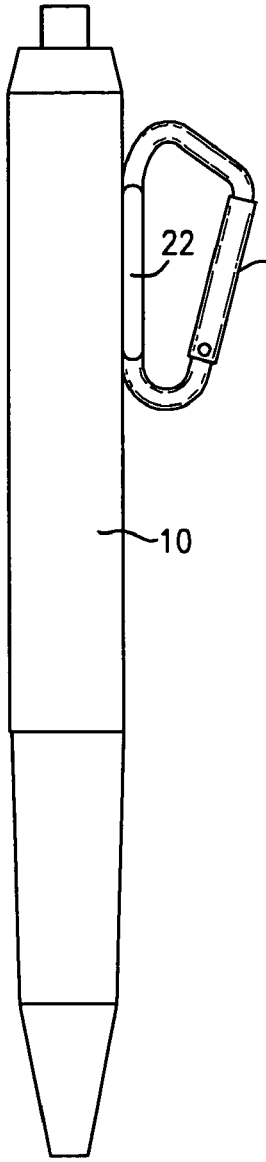
FIG. 5 is a front view of a further embodiment of the present invention.
Figure 5A:
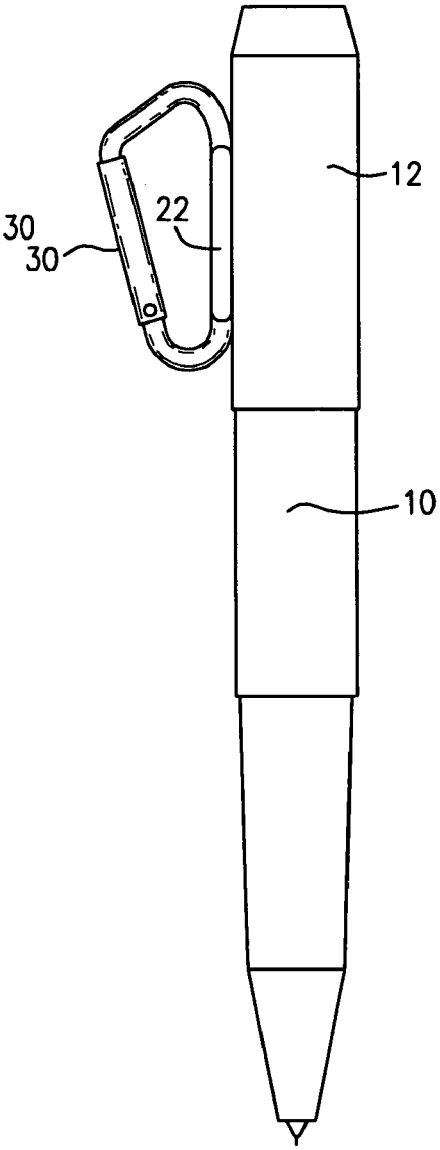
FIG. 5A is a back view of an alternate embodiment of the present invention as shown in FIG. 5.
Figure 5B:
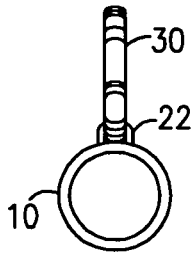
FIG. 5B is a top view of the preferred embodiment of FIG. 5A.
Figure 5C:
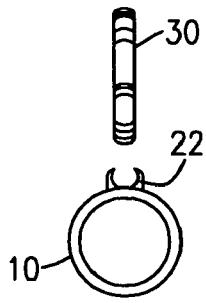
FIG. 5C is a top view of a preferred embodiment of the invention according to FIG. 5A, wherein the carabiner-type attachment device is disengaged from the writing instrument.
Figure 6:
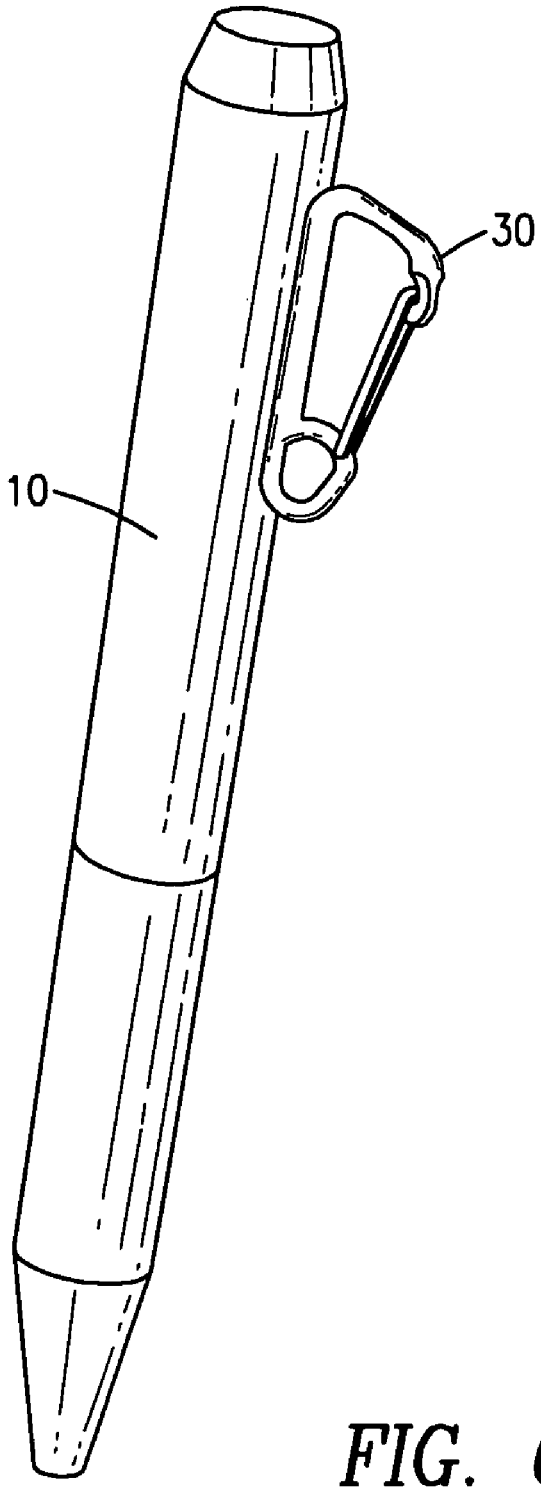
FIG. 6 is a perspective view of a preferred embodiment of the invention.
Figure 7:
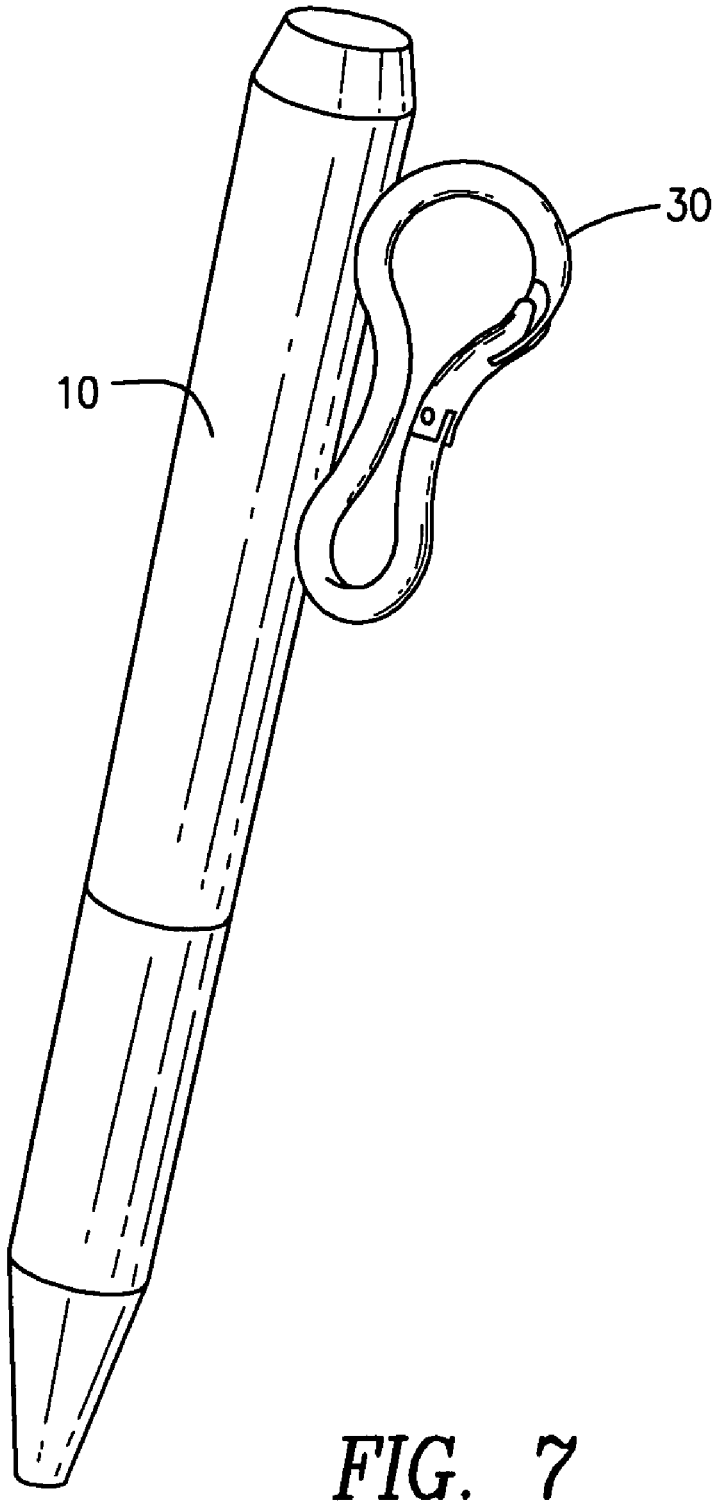
FIG. 7 is a perspective view of a preferred embodiment of the invention.
Figure 8:
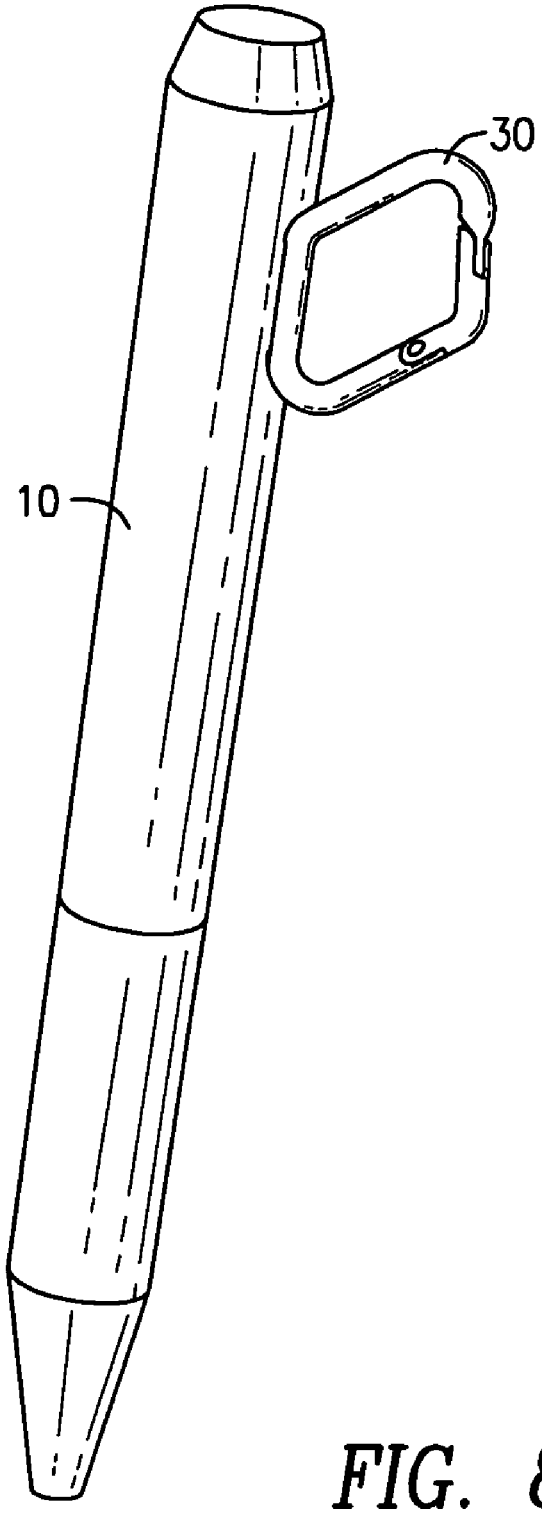
FIG. 8 is a perspective view of a preferred embodiment of the invention.
Figure 9:
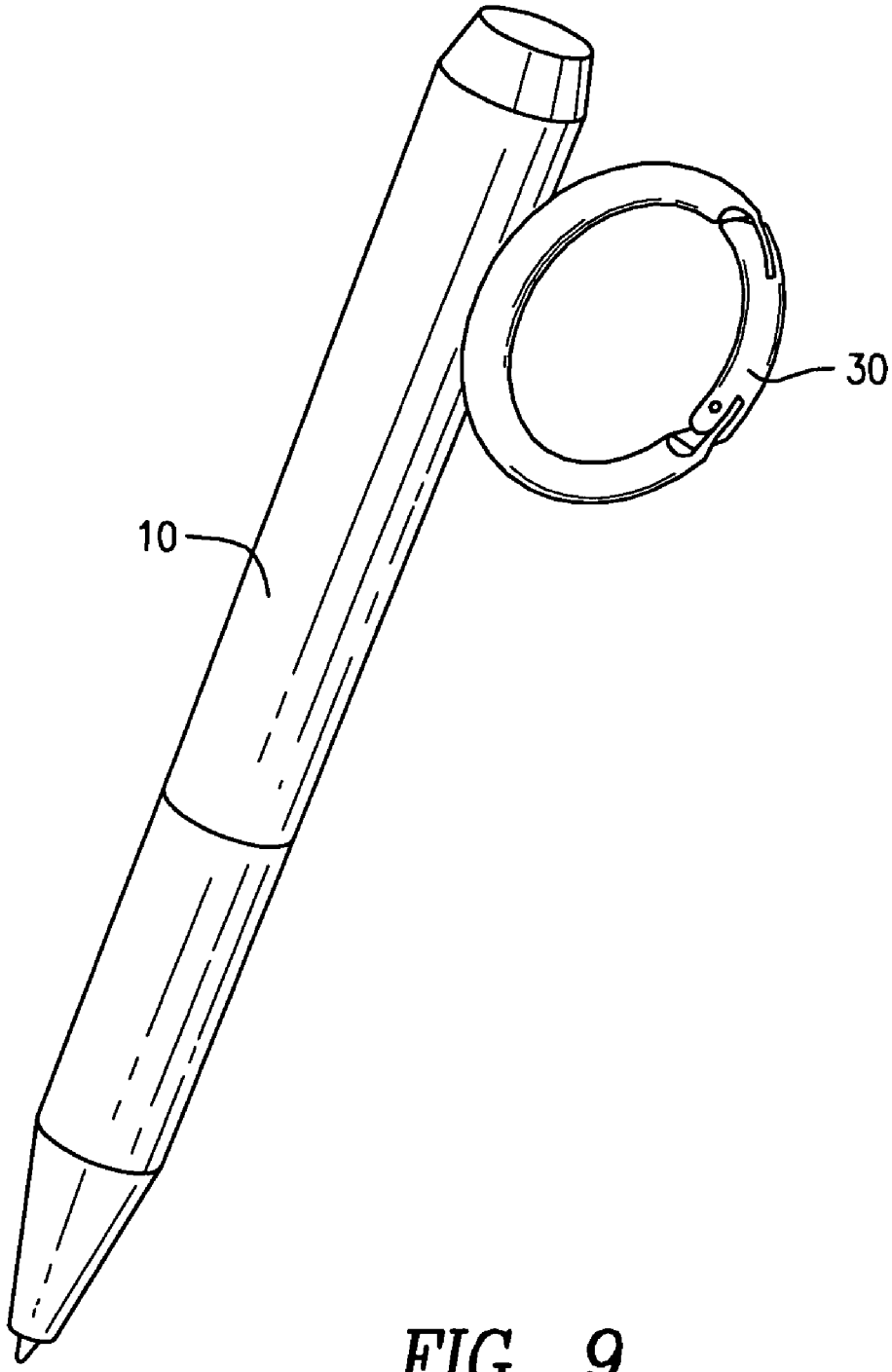
FIG. 9 is a perspective view of a preferred embodiment of the invention.

Now referring to FIGS. 5–5C, in an alternate embodiment the means for attaching said attachment device 30 to said writing instrument 10 is a clip 22 to which attachment device 30 is attached. Clip 22 comprises any material suitable for use in conjunction with a writing instrument such as but not limited to bare or coated metal, wood, rubber, plastic, combinations thereof or any other suitable material as is well known in the art. Clip 22 is attached to said writing instrument 10 or cap 12 by any means known to one having ordinary skill in the art including but not limited to clipping, adhesive, molding or the like. In a preferred embodiment clip 22 comprises a resilient material that permits attachment device 30 to be snapped into place. In other embodiments attachment device 30 may be slidably engaged to clip 22. Now referring to FIG. 5C, in a most preferred embodiment attachment device 30 is removably attached to clip 22.

Now referring to FIGS. 6–9 attachment device 30 may comprise any shape.

While the preferred embodiments have been described and illustrated it will be understood that changes in details and obvious undisclosed variations might be made without departing from the spirit and principle of the invention and therefore the scope of the invention is not to be construed as limited to the preferred embodiment.

What is claimed is:

1. An invention comprising a writing instrument and at least one attachment device extending from a side of said writing instrument, said attachment device comprising at least one selectively openable gate member for allowing said writing instrument to be selectively, removably attached to another item, wherein said attachment device comprises an elongated body member having a first end and a second end, and said gate member having a first end and a second end, said first end of said gate member being attached to said first end of said body member, said second end of said gate member contacting said second end of said body member when said gate is in a closed position and being away from said second end of said body member when said gate is in an open position.

2. The invention according to claim 1 wherein said gate member is integrated with said body member and extends from said first end of said body member.

3. The invention according to claim 1 wherein said first end of said gate member is pivotally attached to said first end of said body member.

4. The invention according to claim 1 wherein said writing instrument further comprises a cap.

5. The invention according to claim 4 wherein said attachment device is integrally formed with said side of said writing instrument or the side of said cap of said writing instrument.

6. The invention according to claim 1 wherein said attachment device comprises a resilient material.

7. The invention according to claim 1 wherein said attachment device is removably attachable to said writing instrument or said cap of said writing instrument.

8. The invention according to claim 1 wherein said attachment device is formed in the shape of a carabiner.

9. The invention according to claim 1 wherein said gate member is inwardly openable.

10. The invention according to claim 1 wherein said gate member is resilient.

11. The invention according to claim 1 wherein said writing instrument is cylindrical.

12. The invention according to claim 1 wherein said writing instrument is a pen.

13. The invention according to claim 1 wherein said writing instrument is a pencil.

14. The invention according to claim 1 further comprising a shirt pocket attachment clip.

15. The invention according to claim 1 further comprising a means for attaching said attachment device to said writing instrument.

16. The invention according to claim 15 wherein said means for attaching comprises a sleeve receivable in said writing instrument, and said attachment device extends from said sleeve.

17. The invention according to claim 16 wherein said writing instrument further comprises a slot for accommodating said attachment device upon insertion of said sleeve in said writing instrument.

18. The invention according to claim 17 wherein said sleeve further comprises a tab, said writing instrument further comprises a lip disposed in the interior of said writing instrument, and said tab is engagable with said lip upon insertion of said sleeve into said writing instrument.

19. The invention according to claim 16 wherein said attachment device is integrally formed with said sleeve.

20. The invention according to claim 15 wherein said attachment means is a band.

21. The invention according to claim 15 wherein said attachment means is a clip.

22. A device comprising a writing instrument and at least one attachment device extending from a side thereof, said attachment device comprising an elongated curvilinear body member comprising first and second ends and a selectively openable gate member having first and second ends, said gate member extending from said body member, wherein said first end of said gate member is pivotally attached to one of said ends of said body member and said second end of said gate member contacts said other end of said body member when said gate is in a closed position, wherein at least a portion of said body member is integrally attached to said writing instrument.

23. The device according to claim 22 wherein said gate member is resilient.

24. A device comprising a cap for a writing instrument and an attachment device extending from a side of said cap, said attachment device comprising at least one elongated curvilinear body member comprising at least a first end, and a gate member having at least a first end, said gate member extending from said body member, said first end of said gate member oriented in close proximity to said first end of said body member, wherein at least a portion of said elongated body member is integrally attached to said cap.

25. The device according to claim 24 said body member further comprising a second end, said gate member further comprising a second end, wherein one of said ends of said gate member is pivotally attached to one of said ends of said body member, the other of said ends of said gate member contacting said other end of said body member when said gate is in a closed position.

26. The device according to claim 24 wherein said gate member is resilient.

27. A device comprising a writing instrument and at least one carabiner secured directly to a side of said writing instrument and further comprising a sleeve receivable in said writing instrument, said carabiner extending from said sleeve, said writing instrument further comprising a slot for accommodating said carabiner upon insertion of said sleeve in said writing instrument.

28. The invention according to claim 27 wherein said carabiner further comprises a band extending therefrom to facilitate attachment of said carabiner to said writing instrument.

29. The invention according to claim 27 wherein said writing instrument further comprises a clip extending therefrom to facilitate attachment of said carabiner to said writing instrument.

30. The invention according to claim 27 wherein said carabiner is removably attached to said writing instrument.

31. A device comprising a writing instrument and at least one carabiner extending from a side of said writing instrument, and a sleeve receivable in said writing instrument, said carabiner extending from said sleeve, said writing instrument further comprising a slot for accommodating said carabiner upon insertion of said sleeve in said writing instrument.

* * * * *

UNITED STATES PATENT AND TRADEMARK OFFICE

CERTIFICATE OF CORRECTION

PATENT NO. : 6,979,143 B2
APPLICATION NO. : 10/459317
DATED : December 27, 2005
INVENTOR(S) : Edward Goldberg It is certified that error appears in the above-identified patent and that said Letters Patent is hereby corrected as shown below:

Column 1, line 6 before "29/179,838" insert --This application is a continuation in part of design Application No.--

Column 1, line 6 before "29/179,765" insert --this application is a continuation in part of design Application No.--

Column 1, line 7 before "29/179,764" insert --this application is a continuation in part of design Application No.--

Column 1, line 8 before "29/179,766" insert --this application is a continuation in part of design Application No.--

Column 1, line 8 before "29/179,839" insert --this application is a continuation in part of design Application No.--

Column 1, line 9 before "29/180,486" insert --this application is a continuation in part of design Application No.--

Signed and Sealed this

Twenty-sixth Day of December, 2006

JON W. DUDAS
*Director of the United States Patent and Trademark Office*